US009180894B2

(12) United States Patent
Taguchi et al.

(10) Patent No.: US 9,180,894 B2
(45) Date of Patent: Nov. 10, 2015

(54) FLOOR STRUCTURE OF RAILCAR

(75) Inventors: Makoto Taguchi, Akashi (JP); Atsushi Sano, Kakogawa (JP); Toshiyuki Yamada, Kobe (JP); Osamu Muragishi, Kakogawa (JP); Masashi Kawamura, Kobe (JP); Yuji Kamei, Himeji (JP); Shuichi Mizuma, Kakogawa (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 101 days.

(21) Appl. No.: 13/882,924

(22) PCT Filed: Nov. 4, 2011

(86) PCT No.: PCT/JP2011/075377
§ 371 (c)(1),
(2), (4) Date: May 1, 2013

(87) PCT Pub. No.: WO2012/063720
PCT Pub. Date: May 18, 2012

(65) Prior Publication Data

US 2013/0213259 A1 Aug. 22, 2013

(30) Foreign Application Priority Data

Nov. 8, 2010 (JP) ..... 2010-249902

(51) Int. Cl.
*B61D 17/10* (2006.01)
*B61D 17/18* (2006.01)
*B61F 1/08* (2006.01)

(52) U.S. Cl.
CPC ..... *B61D 17/10* (2013.01); *B61D 17/18* (2013.01); *B61F 1/08* (2013.01)

(58) Field of Classification Search
CPC ..... B61D 17/10; B61D 17/18
USPC ..... 105/422
See application file for complete search history.

(56) References Cited

U.S. PATENT DOCUMENTS 2,294,357 A * 8/1942 Dean et al. ..... 105/397
4,794,032 A * 12/1988 Fujii et al. ..... 428/209

FOREIGN PATENT DOCUMENTS

| | | |
|---|---|---|
| JP | A-55-132363 | 10/1980 |
| JP | A-59-153654 | 9/1984 |
| JP | A-59-164262 | 9/1984 |
| JP | A-60-234065 | 11/1985 |
| JP | A-61-184167 | 8/1986 |

(Continued)

OTHER PUBLICATIONS

International Search Report issued in International Patent Application No. PCT/JP2011/075377 dated Jan. 17, 2012 (with translation).

*Primary Examiner* — Zachary Kuhfuss
(74) *Attorney, Agent, or Firm* — Oliff PLC

(57) ABSTRACT

Provided is a floor structure of a railcar in which thickness of a heat insulating material can be reduced while having predetermined heat resistance. The floor structure of the railcar includes a underframe having a pair of side sills extending in a railcar longitudinal direction and a cross beam arranged between the side sills and extending in a railcar width direction, a structural floor provided on an upper surface of the underframe, and a first heat insulating material arranged on a lower side of the structural floor via an air layer for the structural floor.

10 Claims, 16 Drawing Sheets

(56) References Cited

FOREIGN PATENT DOCUMENTS

| | | |
|---|---|---|
| JP | A-62-64667 | 3/1987 |
| JP | A-62-189251 | 8/1987 |
| JP | U-63-6970 | 1/1988 |
| JP | A-64-78970 | 3/1989 |
| JP | U-2-75373 | 6/1990 |
| JP | A-8-74346 | 3/1996 |
| JP | A-2000-2031123 | 7/2000 |
| JP | A-2007-191016 | 8/2007 |

* cited by examiner

FLOOR STRUCTURE OF RAILCAR

TECHNICAL FIELD

The present invention relates to a floor structure of a railcar.

BACKGROUND ART

In a railcar, in general, a floor is required to have heat resistance, that is, a heat insulating property and fire resistance. In order to respond to such a requirement, conventionally in a general floor structure of a railcar, a heat insulating material is arranged on a lower surface of a structural floor. Patent Literature 1 discloses a floor structure wherein a highly-fire-resistant and incombustible heat insulating material made of glass wool and a highly-heat-insulating and moisture-retaining heat insulating material made of ceramic fiber are combined as a heat insulating material in order to improve the heat insulating property and the fire resistance. Patent Literature 2 discloses a floor structure of a laminated structure having an upper layer containing hydroxide, a middle layer providing structural strength, and a lower layer covering a lower surface, wherein a heat insulating material is formed between the middle layer and the lower layer.

CITATION LIST

Patent Literature

[PTL 1] JP 61-184167 A
[PTL 2] JP 62-189251 A

SUMMARY OF INVENTION

Technical Problem

As described above, heat resistance of a floor can be improved by complicating the floor structure and increasing thickness of the heat insulating material. However, in a low floor type railcar in which roof height and ceiling height are restricted or in a railcar in which a large underfloor equipment is required to be attached under a floor, length (thickness) in the up and down direction of the floor structure is restricted. With countermeasures as described above, there is sometimes a case where required heat resistance is not easily satisfied.

An object of the present invention is to provide a floor structure of a railcar in which even when thickness of the floor structure is strictly restricted, thickness of a heat insulating material can be reduced while having predetermined heat resistance.

Solution to Problem

In the present invention, a floor structure of a railcar includes a underframe having a pair of side sills extending in a railcar longitudinal direction and a cross beam arranged between the side sills and extending in a railcar width direction, a structural floor provided on an upper surface of the underframe, and a first heat insulating material arranged on a lower side of the structural floor via an air layer for the structural floor.

According to the present invention, the structural floor is covered with the first heat insulating material via the air layer. Thus, since a heat insulating effect is added by the air layer and a heat insulating effect for the entire structure is improved, thickness in the up and down direction of both the air layer and the first heat insulating material can be shortened. As a result, a heat insulating structure on the lower side of the structural floor can be downsized, so that various fixtures are easily arranged under the floor, for example, a large underfloor equipment can be attached.

Advantageous Effects of Invention

In short, according to the present invention, the floor structure of the railcar can be provided in which even when thickness of the floor structure is strictly restricted, thickness of the heat insulating material can be reduced while having predetermined heat resistance.

DESCRIPTION OF EMBODIMENT

Figure 1:
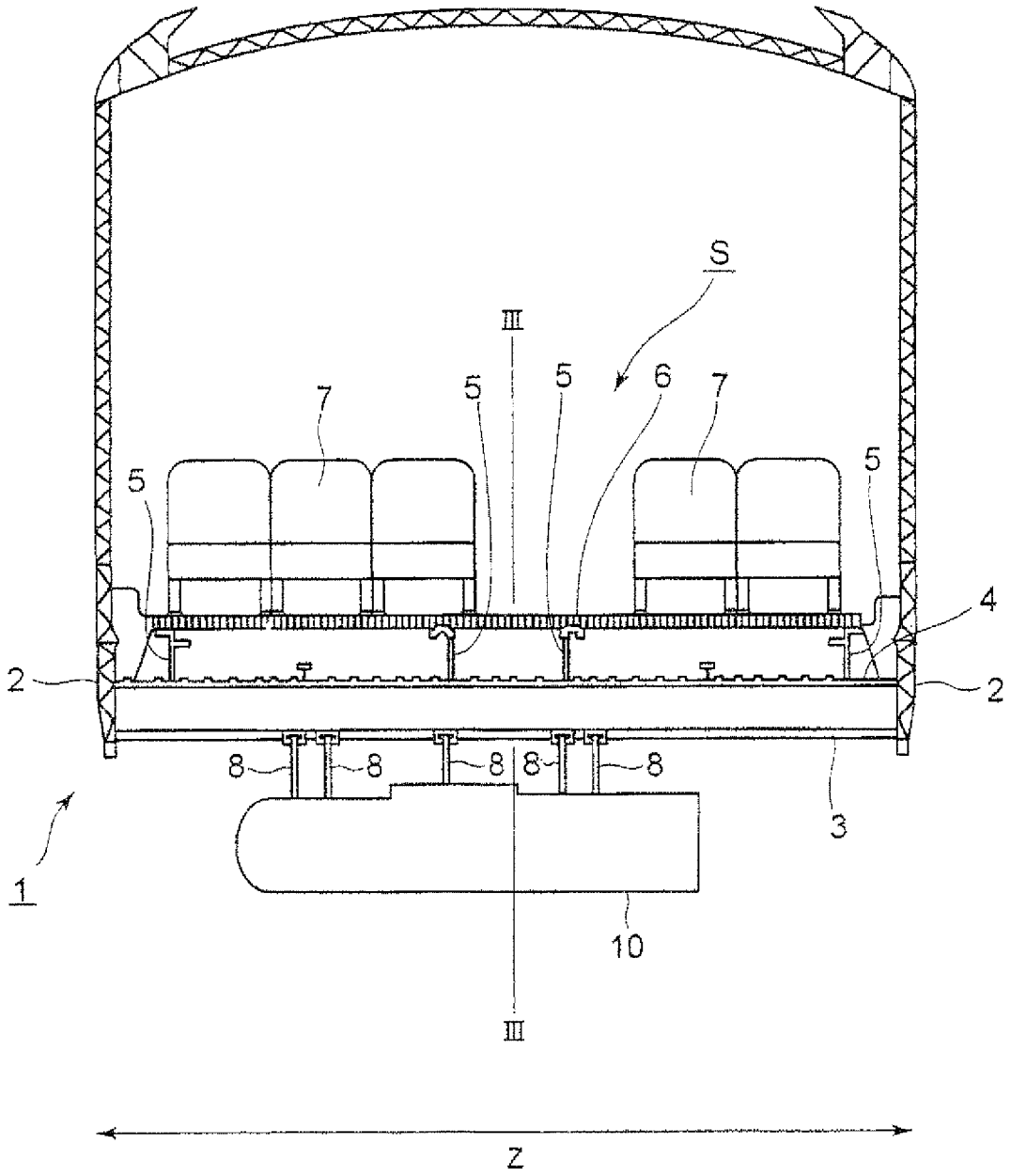
FIG. 1 is a schematic sectional view of a railcar provided with a floor structure according to the present invention.
Figure 2:
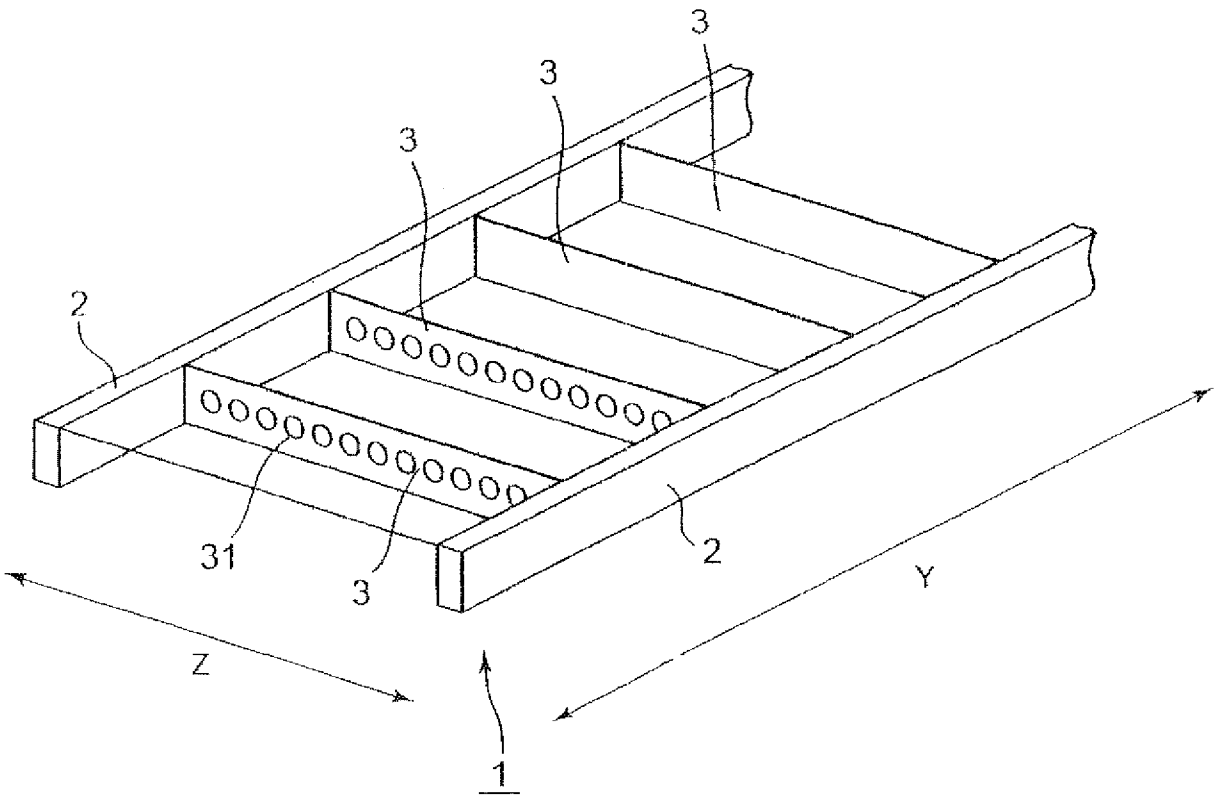
FIG. 2 is a schematic perspective view showing side sills and cross beams.

FIG. 1 is a schematic sectional view of a railcar provided with a floor structure according to the present invention. A underframe 1 is provided in a lowermost part of a carbody shell of the railcar. The underframe 1 has a pair of side sills 2 arranged in the rail direction, that is, in the railcar longitudinal direction (Y direction), and a plurality of cross beams 3 for combining the pair of side sills 2 in the cross sleeper direction, that is, in railcar width direction (z direction). FIG. 2 is a schematic perspective view showing the side sills 2 and the cross beams 3. The cross beams 3 are provided at a pitch of 600 mm to 1,000 mm in the Y direction. In the cross beam 3, a plurality of piping holes 31 into which electric wires, air piping, and the like (hereinafter, simply referred to as the "electric wire and piping etc.") are inserted are provided in line in the Z direction.

A structural floor 4 serving as an air-tight floor is provided on the underframe 1, and a plurality of floor receiving members 5 extending in the Y direction stand on the structural floor 4 at an interval in the Z direction. The floor receiving members 5 support a passenger cabin floor 6 forming a floor of a passenger cabin S on the upper side spaced from the structural floor 4 by a fixed distance. Seats 7 on which passengers are seated are provided on the passenger cabin floor 6.

Figure 3:
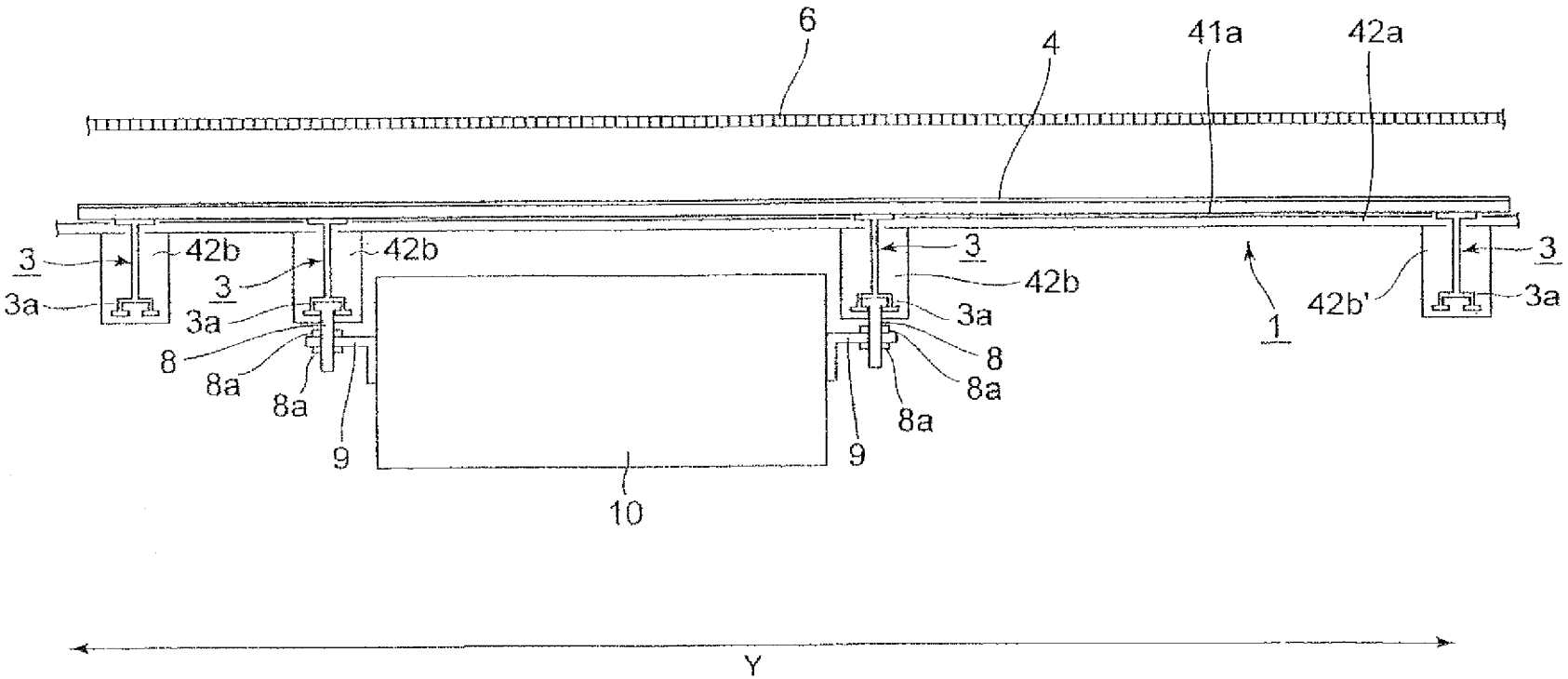
FIG. 3 is a sectional view taken along line of FIG. 1.

FIG. 3 is a sectional view taken along line of FIG. 1. The cross beams 3 have a substantially 1 shape section. In lower parts of the cross beams 3, rectangular suspending groove portions 3*a* whose lower end openings are narrowed down are integrally formed. Head parts of a plurality of suspended bolts 8 are inserted into the suspending groove portions 3*a*. An underfloor equipment 10 is supported by the suspended bolts 8 and nuts 8*a* via brackets 9.

(Heat Resistant Structure of Structural Floor)

Figure 4:
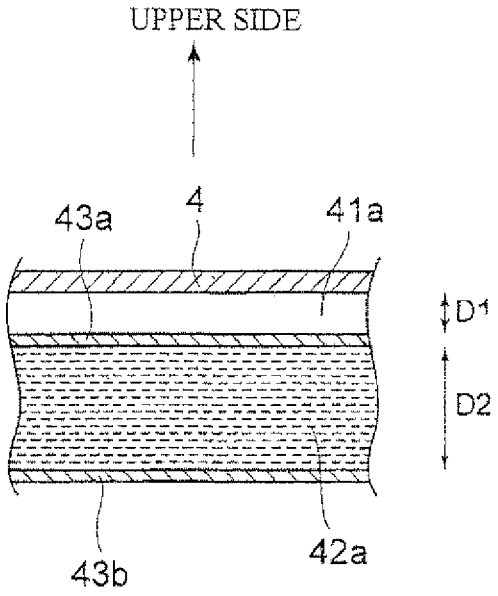
FIG. 4 is an enlarged view of a part of a structural floor where no cross beams are provided in FIG. 3.

FIG. 4 is an enlarged view of a part of the structural floor 4 where no cross beams 3 are provided in FIG. 3. On the lower side of the structural floor 4, a first heat insulating material 42*a* is provided via a space (air layer 41*a*). An upper surface of the first heat insulating material 42*a* is covered with a second metal plate 43*a* and a lower surface of the first heat insulating material 42*a* is covered with a first metal plate 43*b*.

The first heat insulating material 42*a* is preferably formed by using glass fiber or ceramic fiber including alumina fiber. The second metal plate 43*a* and the first metal plate 43*b* are preferably stainless steel. Surface finish such as polishing processing is preferably performed to outer surfaces of the second metal plate 43*a* and the first metal plate 43*b*.

Thickness D1 in the up and down direction of the air layer 41*a* is smaller than thickness D2 in the up and down direction of the first heat insulating material 42*a*. Specifically, the thickness D1 is about ⅓ of the thickness D2.

(Heat Resistant Structure of Cross Beam)

Figure 5:
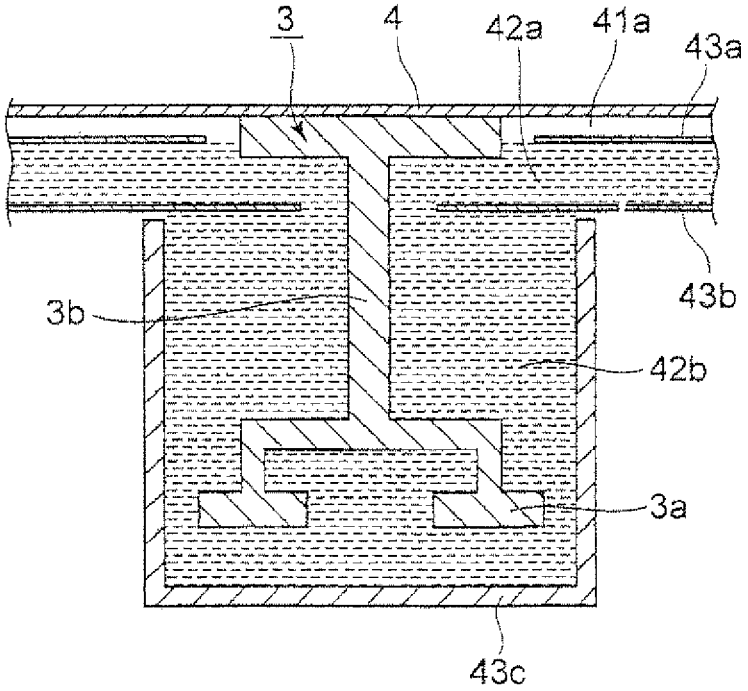
FIG. 5 is an enlarged view of a part of the cross beam where an underfloor equipment is not suspended in FIG. 3.

FIG. 5 is an enlarged view of a part of the cross beam 3 where the underfloor equipment 10 is not suspended in FIG. 3. A lower part of the cross beam 3 and at least a part of a side part, that is, a web 3*b* and the suspending groove portion 3*a* of the cross beam 3 are covered with a second heat insulating material 42*b*. An outer surface of the second heat insulating material 42*b* is covered with a third metal plate 43*c* having a U shape section. An upper surface of the cross beam 3 is attached to the structural floor 4, and upper side parts of the cross beam 3 are covered with the air layer 41*a* or the first heat insulating material 42*a*. The third metal plate 43*c* is supported by the cross beam 3 via the second heat insulating material 42*b*, and the first metal plate 43*b* and the third metal plate 43*c* are not in contact with each other.

Figure 6:
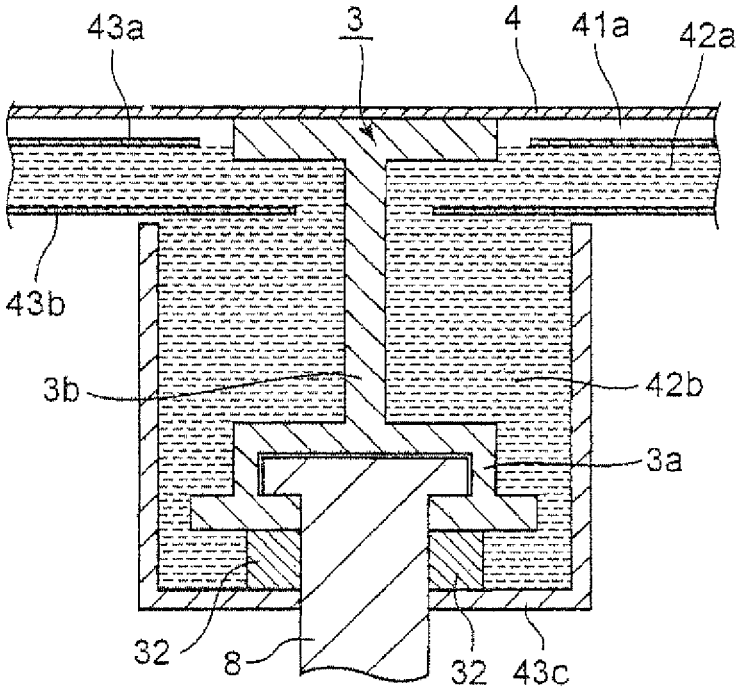
FIG. 6 is an enlarged view of a part of the cross beam where the underfloor equipment is suspended in FIG. 3.

FIG. 6 is an enlarged view of a part of the cross beam 3 where the underfloor equipment 10 is suspended in FIG. 3. The web 3*b* and the suspending groove portion 3*a* of the cross beam 3 are covered with the second heat insulating material 42*b*. The outer surface of the second heat insulating material 42*b* is covered with the third metal plate 43*c*. The third metal plate 43*c* is supported by the suspended bolts 8, and the first metal plate 43*b* and the third metal plate 43*c* are not in contact with each other. A collar 32 is provided on the lower side of the cross beam 3 and on the upper side of the third metal plate 43*c*, and oscillation of the suspended bolts 8 is suppressed by the collar 32.

Figure 7:
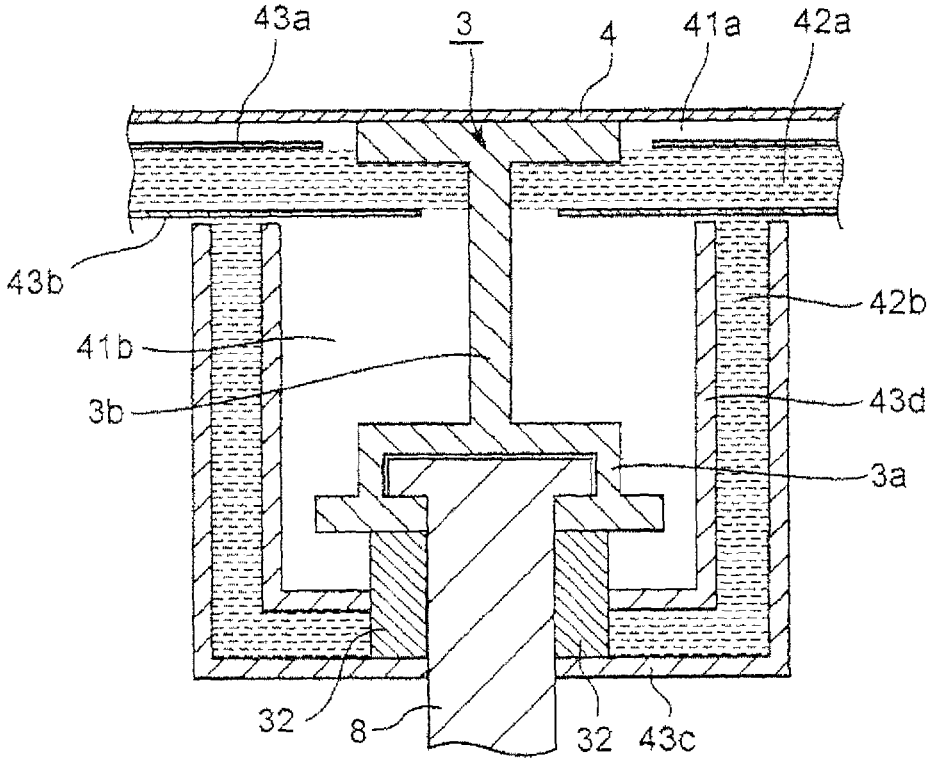
FIG. 7 is a view showing a heat insulating structure of the part of the cross beam where the underfloor equipment is suspended, the heat insulating structure being different from FIG. 6.

FIG. 7 is a view showing a heat resistant structure of the part of the cross beam 3 where the underfloor equipment 10 is suspended, the heat resistant structure being different from FIG. 6 (modified example). As shown in FIG. 7, at least a part of the side part of the cross beam 3 may be covered with the second heat insulating material 42*b* via an air layer 41*b*. That is, the second heat insulating material 42*b* is formed so as to have a U shape section, an outside surface is covered with the third metal plate 43*c*, and an inside surface is covered with a fourth metal plate 43*d*. The air layer 41*b* is provided between the fourth metal plate 43*d* on the inner side and the cross beam 3. The third metal plate 43*c* and the fourth metal plate 43*d* covering the second heat insulating material 42*b* are supported by the suspended bolts 8, the first metal plate 43*b* and the third metal plate 43*c* are not in contact with each other, and the first metal plate 43*b* and the fourth metal plate 43*d* are not in contact with each other.

Figure 8:
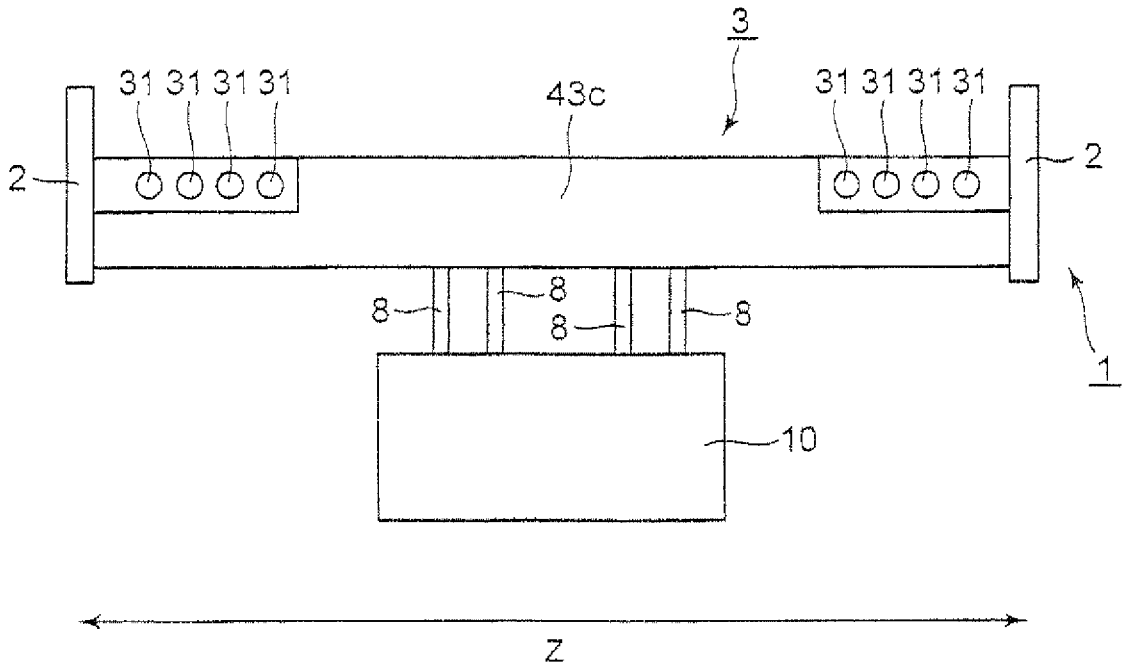
FIG. 8 is a front view of the cross beam covered with a second heat insulating material.

FIG. 8 is a front view in the Y direction of the cross beam 3 covered with the second heat insulating material 42*b*. Among the plurality of piping holes 31 provided in line in the Z direction of the cross beam 3, the electric wire and piping etc. are actually inserted into parts excluding a substantially center part in the Z direction, for example, both ends in the Z direction. Therefore, excluding the parts of several piping holes 31 in both the ends in the Z direction, the cross beam 3 is covered with the second heat insulating material 42*b* which is covered with the third metal plate 43*c*.

The second heat insulating material 42*b* is preferably the same as the first heat insulating material 42*a*. The third metal plate 43*c* and the fourth metal plate 43*d* are preferably the same as the second metal plate 43*a* and the first metal plate 43*b*.

(Metal Plate Attachment Structure)

Figure 9:
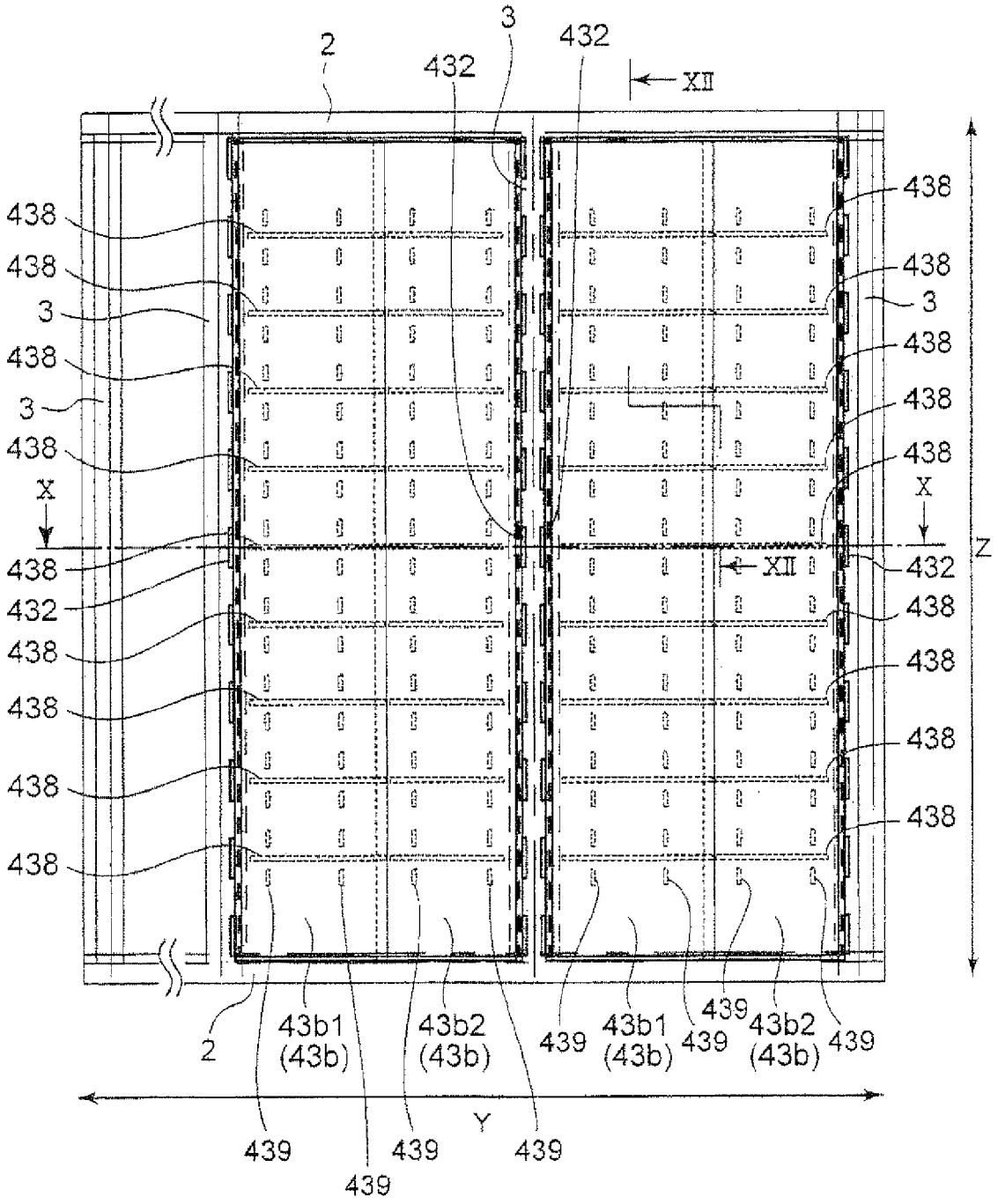
FIG. 9 is a view in which a metal plate covering a lower surface of a first heat insulating material is seen from the lower side.
Figure 10:
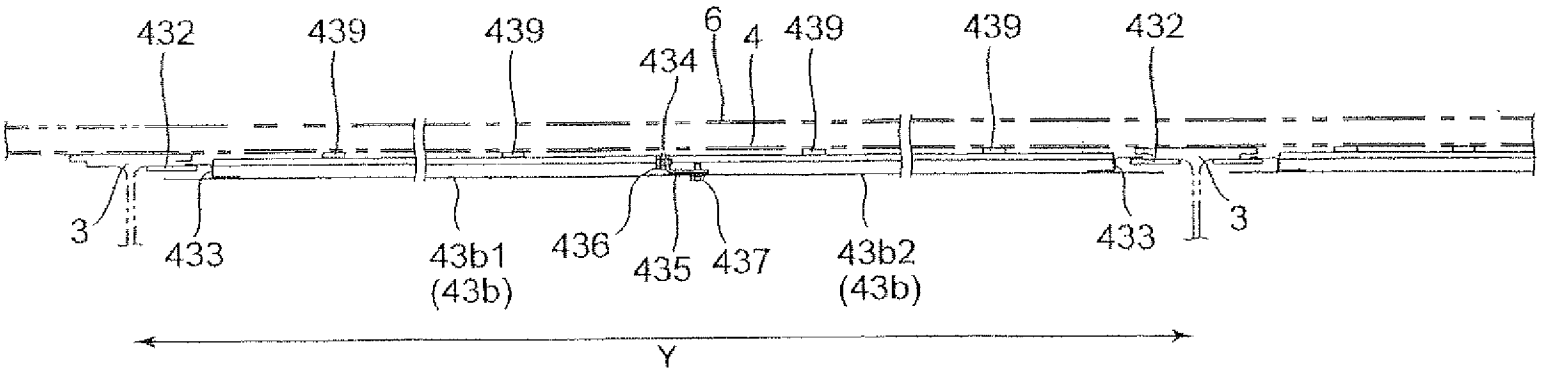
FIG. 10 is a sectional view taken along line X-X of FIG. 9.
Figure 12:
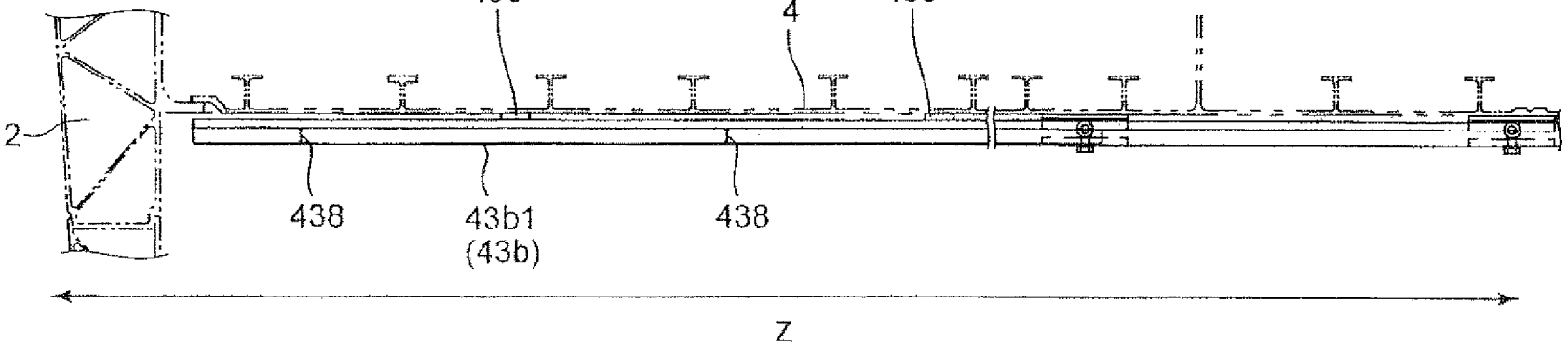
FIG. 12 is a sectional view taken along line XII-XII of FIG. 9.
Figure 13:
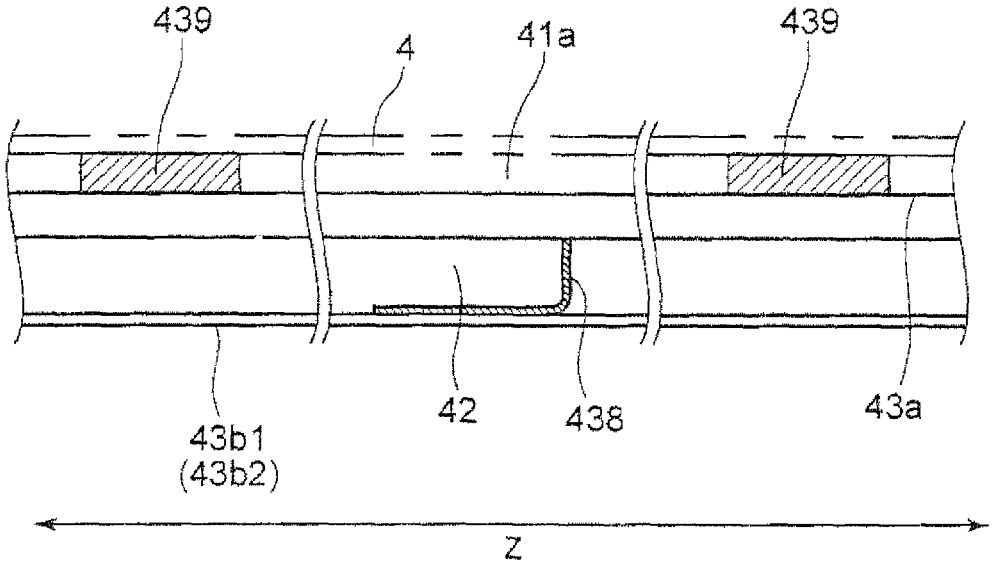
FIG. 13 is a partially enlarged view of FIG. 12.

As shown in FIG. 4, the upper surface and the lower surface of the first heat insulating material 42*a* are covered with the second metal plate 43*a* and the first metal plate 43*b*, respectively. An attachment structure of the first metal plate 43*b* covering the lower surface of the first heat insulating material 42*a* will be described with reference to FIGS. 9 to 13. FIG. 9 is a view in which the first metal plate 43*b* covering the lower surface of the first heat insulating material 42*a* is seen from the lower side. FIG. 10 is a sectional view taken along line X-X of FIG. 9, FIG. 11 is a partially enlarged view of FIG. 10, FIG. 12 is a sectional view taken along line XII-XII of FIG. 9, and FIG. 13 is a partially enlarged view of FIG. 12.

In FIG. 10, in order to prevent downward deflection of the first metal plate 43*b*, between the cross beams 3 in the Y direction, the first metal plate 43*b* is formed by combining two first metal plates 43*b*1, 43*b*2 in a substantial center in the Y direction. In upper parts of the cross beams 3, plate-shaped first plate members 432 are attached by welding. To ends of the first metal plate 43*b*1 and the first metal plate 43*b*2 on the side of the cross beams 3, first support members 433 formed in a Z shape when seen in the Z direction are attached by welding. By inserting ends of the first support members 433 into gaps between the cross beams 3 and the first plate members 432 and mounting the ends on the first plate members 432, the ends of the first metal plate 43*b*1 and the first metal plate 43*b*2 are supported by the cross beams 3. Upon underfloor fire, the first metal plate 43*b*1 and the first metal plate 43*b*2 are brought into direct contact with flame. However, the first plate members 432 are attached to the cross beams 3 on the upper side of the first metal plate 43*b*1 and the first metal plate 43*b*2. Further, the first metal plate 43*b*1 and the first metal plate 43*b*2 extend toward the cross beams 3 on the lower side of the first plate members 432. With such a configuration, direct contact of the first plate members 432 with the flame can be prevented.

In FIG. 9, the plurality of first plate members 432 are provided at an interval in the Z direction. Upon the underfloor fire, since the first plate members 432 are divided and attached to the cross beams 3, a contact area of the first plate members 432 and the cross beams 3 is reduced. As a result, a heat transmission amount from the first metal plates 43*b*1, 43*b*2 to the cross beams 3 is reduced. Therefore, a temperature increase of the cross beams 3 can be reduced.

Figure 11:
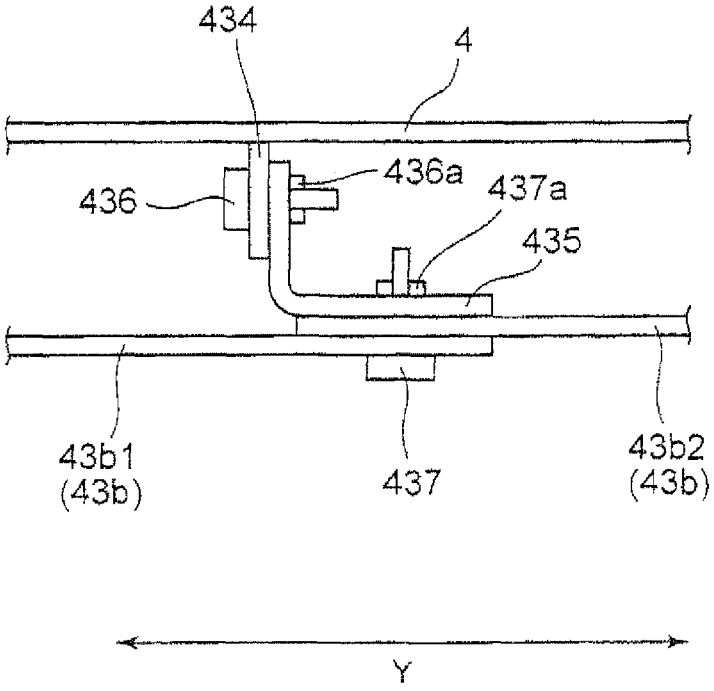
FIG. 11 is a partially enlarged view of FIG. 10.

FIG. 11 shows a detail of a combining part of the first metal plate 43*b*1 and the first metal plate 43*b*2. In a lower part of the structural floor 4 and in a substantially center part in the Y direction between the cross beams 3, a second plate member 434 extending in the substantially vertical direction from the structural floor 4 is attached by welding. The second plate member 434 and a second support member 435 formed in a substantially L shape when seen in the Z direction are fastened by a bolt 436 and a nut 436*a*, The second support member 435, the first metal plate 43*b*1, and the first metal plate 43*b*2 are fastened by a bolt 437 and a nut 437*a*. Among the second support member 435, a part to be fastened together with the second plate member by the bolt 436 and the nut 436*a* is called a first fastened portion, and a part to be fastened together with the first metal plate 43*b*1 and the first metal plate 43*b*2 by the bolt 437 and the nut 437*a* is called a second fastened portion. Note that, although the second plate member 434 is formed in a substantially L shape in FIG. 11, the shape is not limited thereto, and it may take any shape as long as it is fastened to the second plate member 434 and to the first metal plates 43*b*1, 43*b*2.

As described above, one end of the divided first metal plates 43*b*1, 43*b*2 is inserted between the cross beam 3 and the first plate member 432 and the other end is fastened to the structural floor 4 by the bolt 436 and the bolt 437 via the second support member 435. Therefore, even if, for example, the structural floor 4 is an aluminum alloy and the first metal plate 43*b* is stainless steel, that is, the structural floor 4 and the first metal plate 43*b* are made of different types of materials from each other, the first metal plate 43*b* can be supported by the structural floor 4 by adopting the above attachment structure.

In order to prevent the downward deflection of the first metal plate 43*b*, the first metal plate 43*b* is divided into two of the first metal plate 43*b*1 and the first metal plate 43*b*2. However, further in order to improve rigidity of the first metal plates 43*b*1, 43*b*2, as shown in FIG. 13, stiffeners 438 having an L shape section are preferably attached to upper surfaces of the first metal plates 43*b*1, 43*b*2 by welding. The plurality of stiffeners 438 extend in the Y direction and are provided at an interval in the Z direction.

In FIG. 13, on the lower side of the structural floor 4 and on an upper surface of the second metal plate 43*a* covering the upper surface of the first heat insulating material 42*a*, third support members 439 supporting the structural floor 4 are provided. The plurality of third support members 439 are provided at an interval in the Z direction and the Y direction.

(Heat Deformation Structure)

As shown in FIG. 8, the underfloor equipment 10 is generally suspended in a center part in the Z direction of the cross beam 3. Among the plurality of holes 31 provided in the Z direction, the electric wire and piping etc. are actually inserted into the parts excluding the substantially center part in the Z direction, for example, both the ends in the Z direction.

Since the electric wire and piping etc. are inserted into several piping holes 31 in both the ends, the piping holes 31 cannot be covered with the second heat insulating material 42*b*. Therefore, upon the underfloor fire, a temperature is increased in the parts of the piping holes 31 in both the ends of the cross beam 3, and the cross beam 3 is easily deformed (deflected) downward. Thus, in order to prevent large deformation of the cross beams 3 supporting the underfloor equipment 10, there is a need for reducing a bearing load of the cross beams 3.

Figure 14:
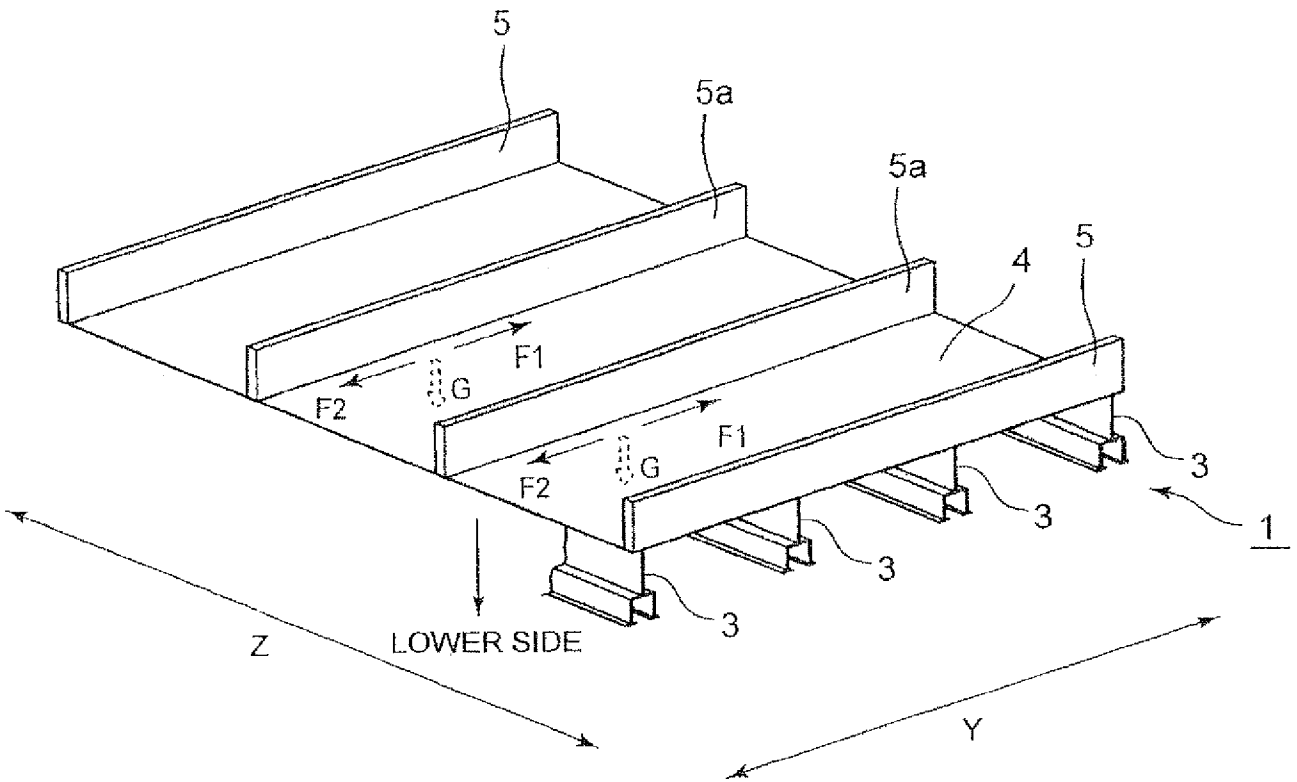
FIG. 14 is a schematic perspective view of the floor structure for reducing a load of the cross beams.

FIG. 14 is a schematic perspective view of the floor structure for reducing the bearing load of the cross beams 3. The floor receiving members 5 extending in the Y direction are provided on the structural floor 4 at an interval in the Z direction. Floor receiving members 5*a* provided in the substantially center part in the Z direction excluding both the ends in the Z direction are welded and fixed to the structural floor 4 over the entire length in the Y direction of the floor receiving members 5*a*.

Figure 15:
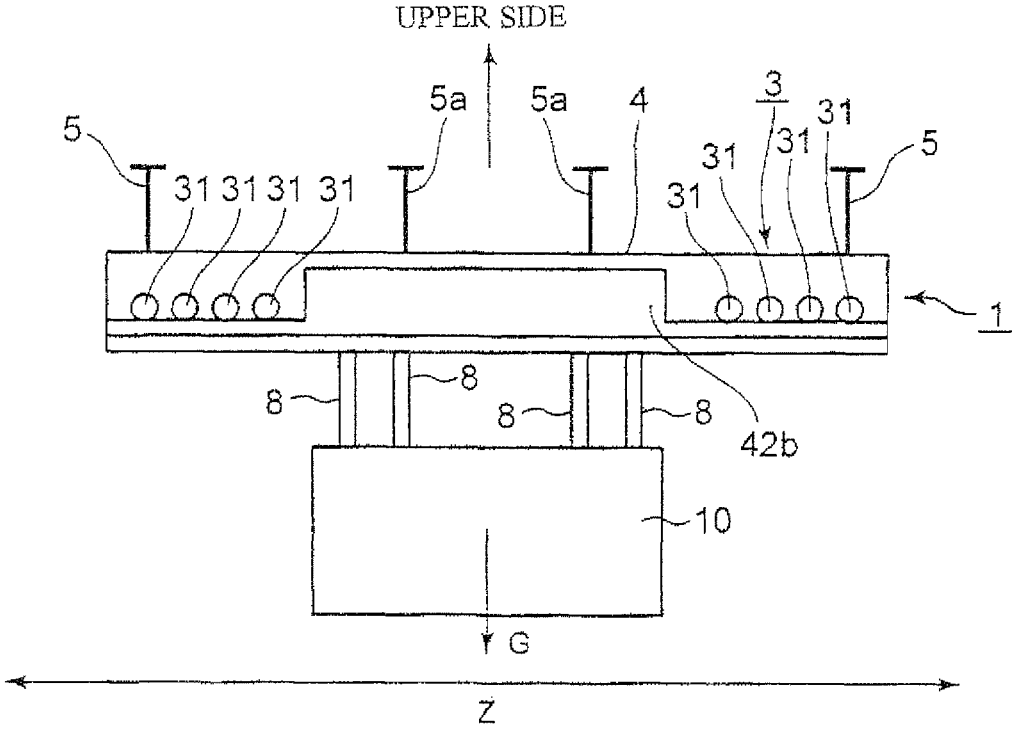
FIG. 15 is a schematic front view of the cross beam showing a state before underfloor fire in the floor structure of FIG. 14.
Figure 16:
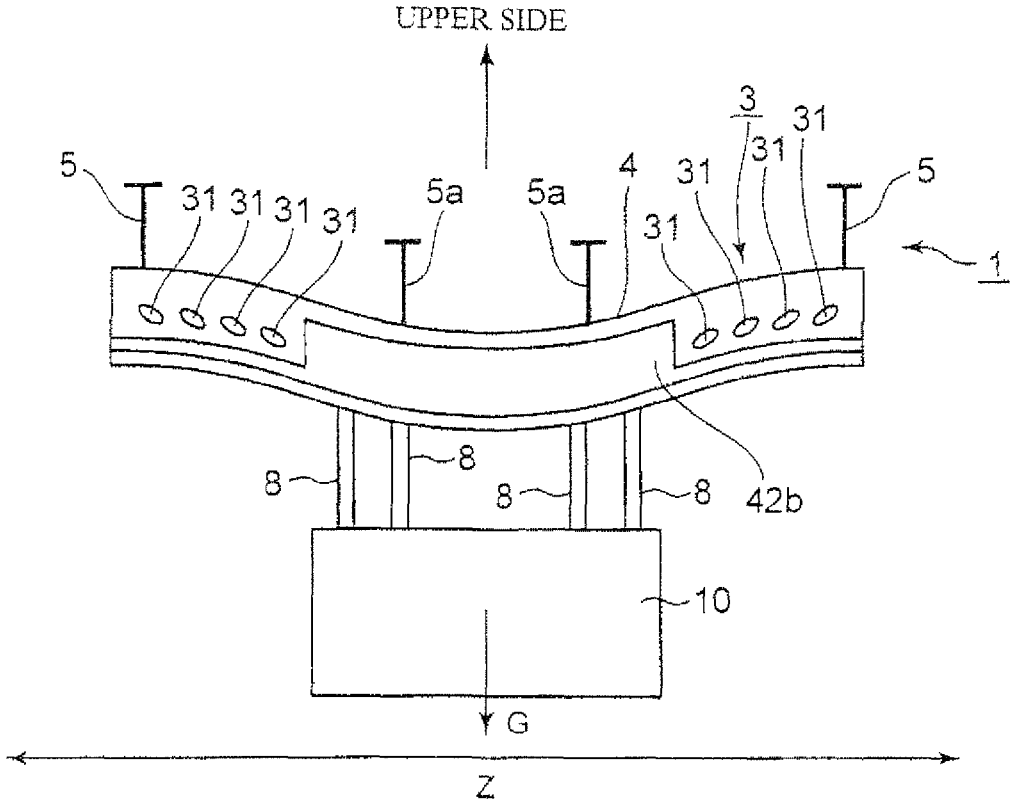
FIG. 16 is a schematic front view of the cross beam showing a state after the underfloor fire in the floor structure of FIG. 14.

FIGS. 15 and 16 are schematic front views of the cross beams 3 each showing a state before the underfloor fire and after the underfloor fire in the floor structure of FIG. 14. In FIGS. 15 and 16, the third metal plate 43*c* covering the second heat insulating material 42*b* is deleted. As shown in FIG. 8, the underfloor equipment 10 is suspended in the center part in the Z direction of the cross beams 3 by the suspended bolts 8. The cross beams 3 are covered with the second heat insulating material 42*b* excluding the parts of the piping holes 31 in both the ends in the Z direction of the cross beams 3.

Upon the underfloor fire, the temperature is increased in the parts of the piping holes 31 in both the ends in the Z direction of the cross beams 3, the parts not being covered with the second heat insulating material 42*b*, so that the cross beams 3 are easily deformed. As a result, the cross beams 3 are deflected downward by a load G of the underfloor equipment 10. The upper parts of the cross beams 3 are attached to the structural floor 4, and the floor receiving members 5 are attached to an upper part of the structural floor 4 so as to couple the cross beams 3. The floor receiving members 5*a* in the substantially center part in the Z direction where the underfloor equipment 10 is suspended are fixed to the structural floor 4 over the entire length in the Y direction of the floor receiving members 5*a*. Note that the floor receiving members 5*a* may be fixed to the structural floor 4 by welding or the floor receiving members 5*a* and the structural floor 4 may be integrated. Therefore, as shown in FIG. 14, the floor receiving members 5*a* can bear a part of the load G of the underfloor equipment 10. That is, a part of the load G of the underfloor equipment 10 is transmitted in the F1 direction and the F2 direction which are parallel to the Y direction through the floor receiving members 5*a*.

According to the present embodiment, the following effects can be obtained.

(1) The structural floor 4 is covered with the first heat insulating material 42*a* via the air layer 41*a*. Thus, while maintaining a heat insulating effect, thickness in the up and down direction (D1+D2) of both the air layer 41*a* and the first heat insulating material 42*a* can be shortened. As a result, a heat insulating structure on the lower side of the structural floor 4 can be downsized, so that the large underfloor equipment 10 can be attached.

Detailed reasons why the heat insulating structure on the lower side of the structural floor 4 can be downsized are as follows.

Figure 17:
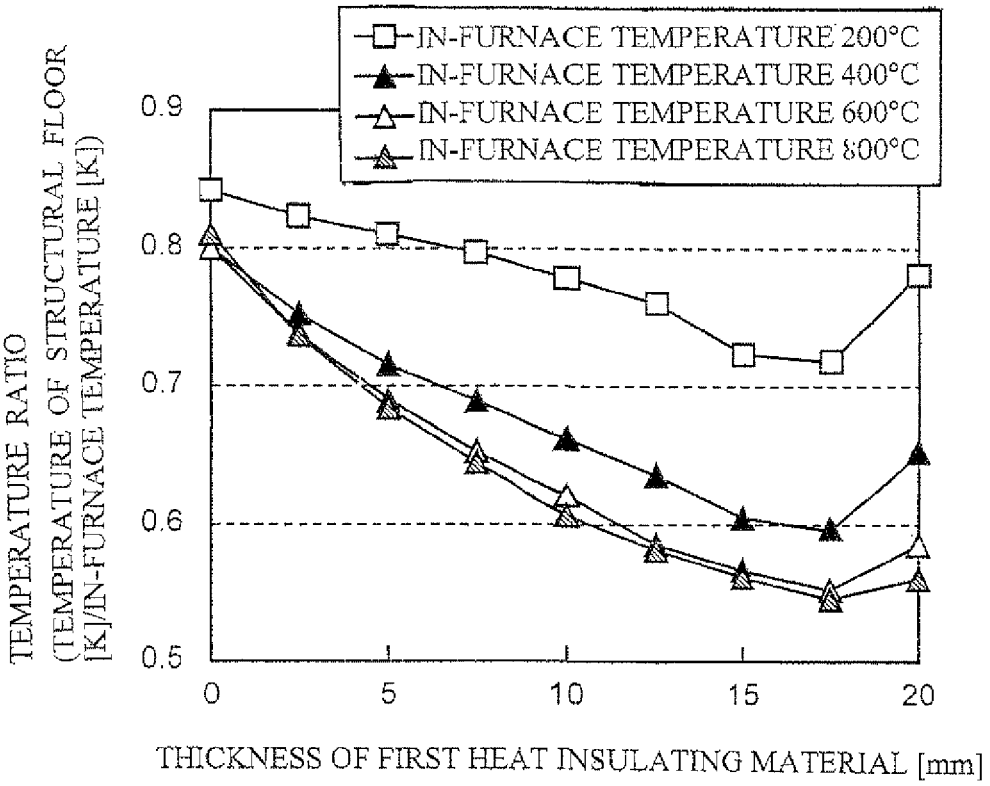
FIG. 17 is a graph showing a temperature ratio between a temperature of the structural floor and an in-furnace temperature with respect to thickness of the first heat insulating material.

In general, a heat transmission mode is classified into heat conduction, heat transfer, and heat emission (radiation). Upon the underfloor fire of the railcar, the heat conduction and the radiation are major. A relationship between the heat conduction and the radiation differs depending on a temperature. The radiation is dominant over the heat conduction at a high temperature (500° C. or more) and the heat conduction is dominant over the radiation at a low temperature (500° C. or less). When the air layer 41*a* and the first heat insulating material 42*a* are compared, a heat conduction property is lower in the air layer 41*a* than the first heat insulating material 42*a*. Meanwhile, a property for blocking the radiation is higher in the first heat insulating material 42*a* than the air layer 41*a*. Therefore, in the case of underfloor fire, a temperature on the lower side is high and a temperature on the upper side is low. Thus, by arranging the first heat insulating material 42*a* having a high property for blocking the radiation on the lower side and arranging the air layer 41*a* having a low heat conduction property on the upper side, the thickness in the up and down direction of both the air layer 41*a* and the first heat insulating material 42*a* (hereinafter, referred to as the "thickness") can be thinnest. When a temperature of the flame is about 1,000° C., a temperature of the lower surface of the first heat insulating material 42*a* becomes about 800° C. In order to make a temperature of a lower surface of the air layer 41*a* about 500° C. (by heat insulating with the first heat insulating material 42 at the temperature at which the radiation is dominant and by heat conduction with the air layer 41*a* at the temperature at which the heat conduction is dominant) and to make a temperature of the structural floor 4 about 350° C. (for example, in a case where a light aluminum alloy is used for the structural floor 4, the temperature of the structural floor 4 is preferably suppressed to be about 350° C.), the thickness D1 of the air layer 41*a* is preferably smaller than the thickness D2 of the first heat insulating material 42*a*. Further, the thickness D1 of the air layer 41*a* is preferably about ⅓ of the thickness D2 of the first heat insulating material 42*a*. FIG. 17 is a graph showing a temperature ratio between the temperature of the structural floor 4 and an in-furnace temperature (corresponding to the temperature of the underfloor fire) with respect to the thickness of the first heat insulating material 42*a* in a case where the sum of the thickness D1 of the air layer 41*a* and the thickness D2 of the first heat insulating material 42*a* is 20 mm. From FIG. 17, for example when the sum of the thickness D1 of the air layer 41*a* and the thickness D2 of the first heat insulating material 42*a* is about 20 mm, the thickness D1 of the air layer 41*a* is preferably about 2.5 to 5 mm, and the thickness D2 of the first heat insulating material 42*a* is preferably about 17.5 to 15 mm.

(2) Since the first metal plate 43*b* is provided on the lower surface of the first heat insulating material 42*a*, the first heat insulating material 42*a* can be protected from the flame upon the underfloor fire. Since the first heat insulating material 42*a* can be supported by the first metal plate 43*b*, there is no need for providing a special member for supporting the first heat insulating material 42*a*.

(3) Since the second metal plate 43*a* is provided on the upper surface of the first heat insulating material 42*a*, radiation heat to the structural floor 4 from the lower side by the underfloor fire can be reduced.

(4) The lower part of the cross beam 3 and at least a part of the side part are covered with the second heat insulating material 42*b* or covered with the second heat insulating material 42*b* via the air layer 41*b*. Thus, fire resistance and a heat insulating property of the cross beams 3 can be improved upon the underfloor fire. By covering the cross beams 3 with the second heat insulating material 42*b* via the air layer 41*b*, as well as the heat insulating structure of the structural floor 4 described above, the thickness of both the air layer 41*b* and the second heat insulating material 42*b* can be shortened. As a result, the heat insulating structure around the cross beams 3 can be downsized.

(5) Since the second heat insulating material 42*b* is covered with the third metal plate 43*c*, the second heat insulating material 42*b* can be protected from the flame upon the underfloor fire. Since the second heat insulating material can be supported by the third metal plate 43*c* and the fourth metal plate 43*d*, there is no need for providing a special member for supporting the second heat insulating material 42*b*.

(6) The first metal plate 43*b* and the third metal plate 43*c* are not in contact with each other, and the first metal plate 43*b* and the fourth metal plate 43*d* are not in contact with each other. Thus, heat strain can be prevented from being generated between the first metal plate 43*b* and the third metal plate 43*c* and between the first metal plate 43*b* and the fourth metal plate 43*d*, and large deformation, cracking, or the like can be prevented from being generated between the first metal plate 43*b* and the third metal plate 43*c* and between the first metal plate 43*b* and the fourth metal plate 43*d*.

(7) Since the first metal plate 43*b* is divided into two of the first metal plate 43*b*1 and the first metal plate 43*b*2, a downward deflection amount of the first metal plate 43*b* can be reduced.

(8) The first metal plate 43*b* is inserted into the gaps between the cross beams 3 and the first plate members 432 and mounted on and supported by the first plate members 432. The first metal plate 43*b* is fastened to the structural floor 4 by the bolts 436, 437 via the second support member 435. Therefore, different materials from the cross beams 3 and the structural floor 4 can be used for the first metal plate 43*b*. For example, the cross beams 3 and the structural floor 4 can be a light aluminum alloy, and the first metal plate 43*b* can be stainless steel having high fire resistance.

(9) Since the stiffeners 438 are attached to the upper surface of the first metal plate 43*b*, the rigidity of the first metal plate 43*b* can be improved. As a result, the downward deflection amount of the first metal plate 43*b* can be reduced.

(10) Since the third support members 439 are provided on the upper surface of the second metal plate 43*a*, the third support members 439 support the structural floor 4 so as to reduce the downward deflection amount of the structural floor 4.

(11) The piping holes 31 into which piping is placed are provided in the Y direction in both the ends in the Z direction of the cross beams 3, and the second heat insulating material 42*b* is formed such that the piping holes 31 are exposed. Thus, the electric wire and piping etc. of the underfloor equipment 10 and the like can be placed in both the ends in the Z direction of the cross beam 3, so that a wiring structure can be prevented from being complicated.

(12) Since the floor receiving members 5*a* are welded and fixed to the structural floor 4 over the entire length in the Y direction of the floor receiving members 5*a*, the floor receiving members 5*a* can receive a part of the load G of the underfloor equipment 10. Therefore, even in a case where the temperature of both the ends of the cross beams 3 is increased by the underfloor fire and the cross beams 3 are easily deformed downward, a part of the load G of the underfloor equipment 10 is distributed to the floor receiving members 5*a* and a load received by the cross beams 3 is reduced. Thus, a downward deformation amount of the cross beams 3 can be reduced. By reducing the downward deformation amount of the cross beams 3, a downward deformation amount of the structural floor 4 and further the passenger cabin floor 6 can be reduced.

(13) Since the surface finish such as the polishing processing is performed to the outer surfaces of the second metal plate 43*a*, the first metal plate 43*b*, the third metal plate 43*c*, and the fourth metal plate 43*d*, emissivity of the outer surfaces of the second metal plate 43*a*, the first metal plate 43*b*, the third metal plate 43*c*, and the fourth metal plate 43*d* is low. As a result, heat emission from the second metal plate 43*a*, the first metal plate 43*b*, the third metal plate 43*c*, and the fourth metal plate 43*d* can be reduced.

As well as the cross beams 3 and the structural floor 4, the side sills 2 are preferably covered with a heat insulating material, and further preferably covered with a heat insulating material via an air layer.

In the present embodiment, the floor receiving members 5*a* in the substantially center part in the Z direction where the underfloor equipment 10 is suspended are welded and fixed to the structural floor 4 over the entire length in the Y direction of the floor receiving members 5*a*. However, the present invention is not limited to the floor receiving members 5*a* in the substantially center part in the Z direction, but all the floor receiving members 5 may be welded and fixed to the structural floor 4 over the entire length in the Y direction of the floor receiving members 5. Although the floor receiving members 5*a* are welded and fixed to the structural floor 4, a fixing method thereof is not limited to welding, but any method can be used as long as the floor receiving members 5*a* are attached to the structural floor 4 so as to bear a part of the load of the underfloor equipment 10. For example, the floor receiving members 5*a* may be integrated with the structural floor 4 or the floor receiving members 5*a* may be fastened to the structural floor 4 by bolts and nuts. The floor receiving members 5*a* may be attached to the structural floor 4 via connection members serving as separate bodies from the floor receiving members 5*a*.

In the present embodiment, the piping holes 31 are provided in both the ends in the Z direction of the cross beams 3. However, the piping holes 31 may be provided anywhere in the cross beams 3 as long as it is within a range not corresponding to a part substantially immediately below the floor receiving members 5*a* in the substantially center part in the Z direction where the underfloor equipment 10 is suspended.

The present invention is not limited to the configuration described in the above embodiment, but can include various modified examples that those skilled in the art can anticipate without departing from the contents described in the claims.

INDUSTRIAL APPLICABILITY

In the present invention, the floor structure of the railcar can be provided in which the thickness of both the air layer and the heat insulating material can be shortened while maintaining a heat resistance effect. Thus, an industrial utility value is high.

REFERENCE SIGNS LIST

1 Underframe
2 Side sill
3 Cross beam
3*a* Suspending groove portion
4 Structural floor
41*a* Air layer
41*b* Air layer
42*a* First heat insulating material
42*b* Second heat insulating material
43*a* Second metal plate
43*b* First metal plate
43*c* Third metal plate
43*d* Fourth metal plate
432 First plate member
433 First support member
434 Second plate member
435 Second support member
436 Bolt
437 Bolt
438 Stiffener
439 Third support member
5 Floor receiving member
5*a* Floor receiving member
6 Passenger cabin floor
7 Seat
8 Suspended bolt
9 Bracket
10 Underfloor equipment

The invention claimed is:

1. A floor structure of a railcar comprising:

an underframe having a pair of side sills extending in a railcar longitudinal direction and a cross beam arranged between the side sills and extending in a railcar width direction;

a structural floor provided on an upper surface of the underframe;

a first heat insulating material arranged on a lower side of the structural floor via an air layer for the structural floor;

a first metal plate provided on a lower surface of the first heat insulating material, wherein the structural floor, the air layer for the structural floor, the first heat insulating material, and the first metal plate are arranged in order from a structural floor side to a lower side;

a first plate member provided in an upper end part of the cross beam; and a first port member extending from an upper surface of the first metal plate toward the first plate member and connecting the first metal plate and the first plate member, wherein the first metal plate extends toward the cross beam on the lower side of the first plate member.

2. The floor structure of the railcar according to claim 1, further comprising:

a second plate member extending in a substantially vertical direction from a lower surface of the structural floor; and a second support member provided on the upper surface of the first metal plate, wherein the first metal plate is formed by fastening at least two metal plates, and by fastening the second plate member and the second support member, the first metal plate is attached to the structural floor.

3. The floor structure of the railcar according to claim 2, wherein the second support member is formed in a substantially L shape having a first fastened portion extending in parallel to the first metal plate and a second fastened portion extending in the vertical direction, the first fastened portion is fastened together with the at least two first metal plates, and the second fastened portion is fastened together with the second plate member.

4. The floor structure of the railcar according to claim 1, further comprising a second metal plate provided on an upper surface of the first heat insulating material, wherein the structural floor, the air layer for the structural floor, the second metal plate, the first heat insulating material, and the first metal plate are arranged in order from the structural floor side to the lower side.

5. The floor structure of the railcar according to claim 1, wherein at least a part of a side part of the cross beam is covered with a second heat insulating material.

6. The floor structure of the railcar according to claim 5, wherein the second heat insulating material is covered with a third metal plate.

7. The floor structure of the railcar according to claim 5, further comprising a piping hole extending in the railcar longitudinal direction into which wiring is capable of being placed in the cross beam within a range not corresponding to a part substantially immediately below a floor receiving member which is provided in a substantially center part in the railcar width direction, and the second heat insulating material is formed such that the piping hole is exposed.

8. The floor structure of the railcar according to claim 1, wherein at least a part of a side part of the cross beam is covered with a second heat insulating material via an air layer for the cross beam.

9. The floor structure of the railcar according to claim 2, further comprising stiffeners having an L-shape section attached to upper surfaces of the at least two first metal plates, wherein the stiffeners extend in the railcar longitudinal direction and are provided at intervals in the railcar width direction.

10. The floor structure of the railcar according to claim 2, further comprising third support members supporting the structural floor on the lower side of the structural floor and on an upper surface of a second metal plate covering an upper surface of the first heat insulating material, wherein the third support members are provided at intervals in the railcar longitudinal direction and the railcar width direction.

* * * * *